US005447333A

United States Patent [19]

Kuhns et al.

[11] Patent Number: 5,447,333

[45] Date of Patent: Sep. 5, 1995

[54] METHOD OF PRODUCING A LAMINATED WRINKLE-FREE PRESENTATION FOLDER HAVING PERFECT BINDING SHEETS

[75] Inventors: Roger J. Kuhns, Lincoln; Chris E. Isbell, Burlington; Robert L. Nathans, Billerica, all of Mass.

[73] Assignee: Avant, Incorporated, West Concord, Mass.

[21] Appl. No.: 105,140

[22] Filed: Aug. 12, 1993

[51] Int. Cl.[6] ..... B42D 3/00; B42C 7/00

[52] U.S. Cl. ..... 281/29; 281/31; 281/35; 283/74; 283/79; 283/109; 156/300; 412/8; 412/900; 493/947

[58] Field of Search ..... 412/3, 8, 900, 901; 281/29, 31, 35, 36; 283/64, 74, 79, 107, 109; 428/200, 203, 211; 156/60, 297, 299, 300, 308.2, 908; 40/359; 493/947; 106/22 B, 23 B

[56] References Cited

U.S. PATENT DOCUMENTS

| | | | |
|---|---|---|---|
| 2,411,368 | 11/1946 | Dow | 281/29 X |
| 3,174,773 | 3/1965 | True et al. | 281/29 |
| 4,188,139 | 2/1980 | Pasani et al. | 400/696 |
| 4,606,689 | 8/1986 | Wiholm | 412/3 |
| 4,615,541 | 10/1986 | Kwauka | 412/3 X |
| 4,744,592 | 5/1988 | Barnette et al. | 281/29 X |
| 4,886,299 | 12/1989 | Ducorday | 412/35 X |
| 5,090,732 | 2/1992 | Kuhns et al. | 281/29 |
| 5,100,181 | 3/1992 | Nathans et al. | 281/29 X |

FOREIGN PATENT DOCUMENTS

| | | | |
|---|---|---|---|
| 5-221181 | 8/1993 | Japan | 412/8 |

*Primary Examiner*—S. Thomas Hughes
*Attorney, Agent, or Firm*—Iandiorio & Teska

[57] ABSTRACT

A customized insert sheet is laminated by heat and pressure between a plastic cover sheet and a major portion of a folder sheet. A heat activatable adhesive strip may thereafter be applied to an adhesive strip receiving channel adjacent a side edge of the plastic cover sheet, and edge portions of a stack of sheets may then be affixed to the adhesive strip receiving channel by heating the adhesive strip. The cover sheet is affixed to a side edge portion of the folder sheet to reduce wrinkling of the cover sheet upon lamination.

19 Claims, 1 Drawing Sheet

METHOD OF PRODUCING A LAMINATED WRINKLE-FREE PRESENTATION FOLDER HAVING PERFECT BINDING SHEETS

BACKGROUND OF THE INVENTION

The present invention relates to the field of laminated plastic display devices and includes those used in marketing goods and services.

In U.S. Pat. Nos. 5,042,843 and 5,090,732 incorporated by reference herein and issued to Roger Kuhns et al., and assigned to Avant Inc. of West Concord, Mass., presentation folders are disclosed for storing and displaying sheets of sales material in pouches formed in the folders and which folders may also be rapidly customized by laminating customized insert sheets to the folders by the application of heat and pressure thereto, thereby to result in the production of a highly attracive product. The insert sheets are like the front and back slip-cover of a book and enhance the advertising value of the presentation folder. The graphics and printed matter on the insert sheets may be easily and rapidly produced by a PC desk top publishing program.

It is also known in the art to produce presentation booklets having edge portions of a stack of sheets of promotional material bonded by a heat activatable adhesive material to a spine portion. The result is a sales presentation booklet. This process is well known in the art as perfect binding. Surprisingly, and to the best of our knowledge, no one has marketed a dual-function product that includes both the customized presentation folder having pouches for holding loose sheets as described in the aforesaid patents, and sheets which are bound within the folder by means of perfect binding through the use of a heat activatable adhesive. It is thus an object of the present invention to easily and rapidly produce such a dual function product in an economical manner.

The lamination by heat and pressure of the customized insert sheets between the folder sheets and the heat activatable plastic cover sheets of the presentation folders in the aforesaid patents, is carried out by feeding the folder between rollers of what is known in the trade as a pouch laminator. The plastic cover sheets, covering the customized paper insert sheets, are laminated to the paper folder sheet by the application of heat and pressure as the folder is passed through the pouch laminator. A first pair of entrance rollers conveys the "sandwich" to be laminated between hot platens which melt the heat activatable adhesive, which is commonly polyethylene. The adhesive layer is on the inside surface of the plastic cover sheet facing the paper folder sheet, and the melting of the adhesive laminates the cover sheet to the folder sheet while encapsulating the customized insert sheet between them. A second pair of exit rollers completes the lamination by the application of pressure to the now molten heat activatable adhesive.

During the development of the aforesaid dual function product, we encountered problems in passing the dual function product through the pouch laminator as just described. The presentation folder of the aforesaid patents was modified by forming a pair of closely spaced vertically oriented folds for dividing the folder into a pair of major face portions and for defining a perfect binding adhesive strip receiving area which will be later used to receive the adhesive strip which binds edges of a stack of sheets to the strip by means of a heat activatable adhesive.

These modified presentation folders had the plastic cover sheets affixed to top edge portions of the folders via a heat seal and the customized insert sheets were abutted against the heat seals at the top edge portions as shown in the aforesaid patents. The right half major folder portion was folded over the left hand major folder portion to enfold the plastic cover sheet. The resulting "sandwich" was then passed through the laminator whereby the top heat seal portion was first passed through the entrance roller pair. In other words, the sides of the plastic cover sheets were parallel to the direction of feed of the "sandwich" through the laminator. This procedure, was carried out essentially in accordance with the procedures and folders of the aforesaid patents except for the addition of the second vertically positioned fold which, along with the first fold, defined the perfect binding adhesive strip receiving area or channel for later receiving a strip of heat activatable adhesive to carry out the perfect binding of the edges of the sheets to the central portion of the presentation folder. This simple modification of the prior presentation folders of the patents produced substantial aesthetically unacceptable wrinkling of the plastic cover sheets after being passed through the laminator.

We believe that this unacceptable wrinkling is caused by the fact that the thickness of the side of the folder where the adhesive strip receiving channel is present is less than the thickness of the opposite side portion of the folder. This is because edge portions of the plastic cover sheet and edge portions of the plastic backing sheet extend to the edges of the folder. On the other hand, the side of the folder comprising the perfect binding strip receiving channel is not covered by plastic since the edge of the plastic cover sheet does not cover the strip receiving channel area.

BRIEF SUMMARY OF PREFERRED EMBODIMENTS OF THE INVENTION

Besides providing a folder which can have the aforesaid highly desired dual function, at the same time we solved the wrinkling problem. We discovered that the problem was solved by sealing the plastic cover sheet, or sheets if two are affixed to one folder, to the folder sheet along outer side portions of the folder sheet parallel to the binder strip receiving channel rather than along top portions as was previously the case. We then inserted a side edge portion of the customized insert sheet against the heat seal, folded the right half of the folder sheet over the plastic cover sheet as before but we then first fed the side portion into the laminator so that the direction of feed was parallel to the top and bottom folder portions, rather than perpendicular to the top and bottom portions as was previously the case in the aforesaid patents. To prevent possible shifting of the customized insert sheet, or buckling when flexed after lamination, we can use non-agressive spots of pressure sensitive adhesive such as 3M "POST-IT" type, which can be placed upon the customized insert sheet area.

It is a further object of the invention to provide a highly conspicuous message permanently printed upon all of the folders to remind the user to reorder a fresh supply of folders via the telephone number of the manufacturer. Since such a message will detract from the message of the purchasers of the presentation folders, this would normally be unacceptable. However, the message becomes acceptable since it is made to disappear after lamination by printing the message with a special ink to be described. Should the folders be used exclusively for perfect binding of sheets to the binding strip, the printing need not employ the special ink since the perfect binding operation will cover the printed message if it is printed on the adhesive strip receiving channel or upon the underside of the perfect binding adhesive strip.

BRIEF DESCRIPTION OF THE DRAWINGS

Other objects, features and advantages of the present invention will become apparent upon study of the following detailed description, taken in conjunction with the drawings in which.

DETAILED DESCRIPTION OF PREFERRED EMBODIMENTS OF THE INVENTION

Figure 1:
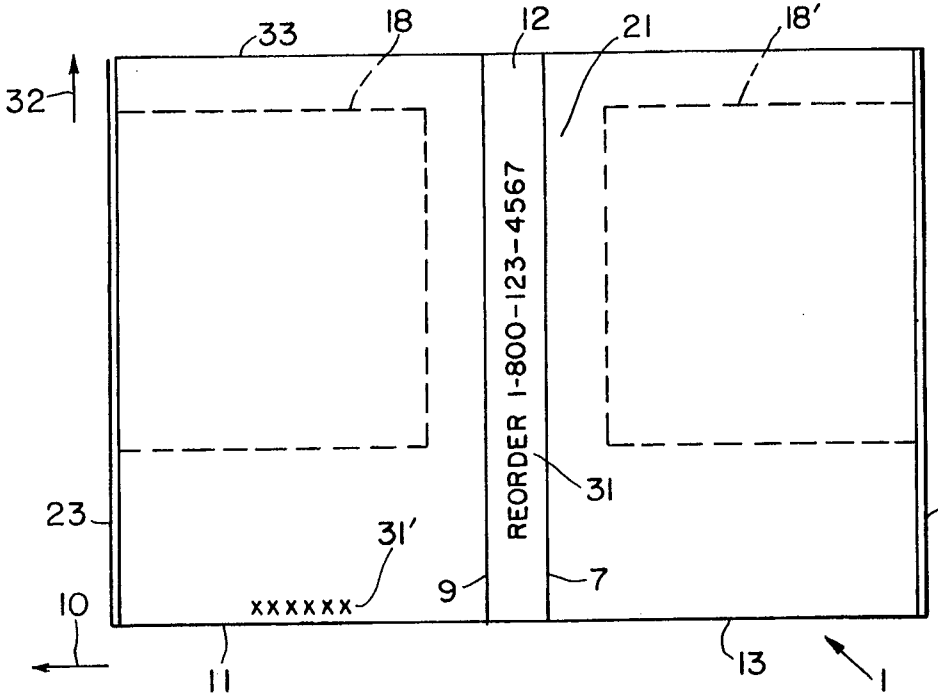
FIG. 1 illustrates a front view of the presentation folder.
Figure 2:
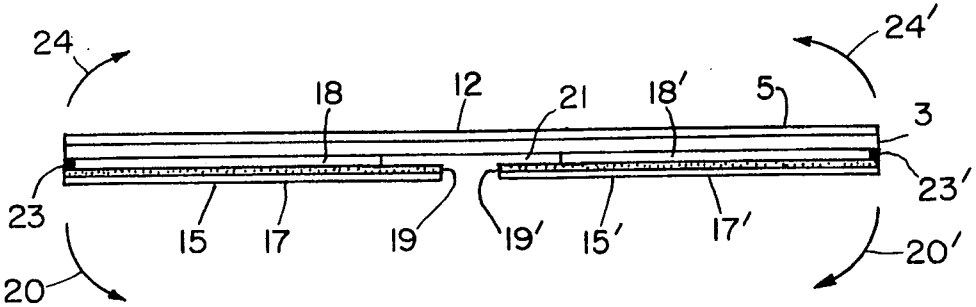
FIG. 2 illustrates a top view of FIG. 1.

As shown in FIGS. 1 and 2, a rectangular folder 1 is provided having a pair of closely spaced parallel vertically oriented folds 7 and 9 extending from a top portion of the folder to a bottom portion for dividing the folder sheet into a first major portion 11 and a second major portion 13 and for defining a perfect binding adhesive strip receiving area or channel 12 between the first and second major portions. The paper folder or core sheet 3 has a thickness typically of about ten mils and is covered by a transparent plastic backing sheet 5 which prevents warpage after lamination as explained in detail in the aforesaid patents to Roger Kuhns et al.

A light transmissive rectangular plastic cover sheet 15 is attached to a first outer face of the folder sheet along a side edge portion 23 which preferrably comprises a heat seal oriented parallel to the folds 7 and 9. The plastic cover sheet can comprise a layer 17 of polyethylene terepthalate, e.g. that sold under the trademark "MYLAR" or "CELENEX", which layer 17 is coated with a layer 19 of a heat activatable adhesive such as polyethylene which faces the folder sheet as shown for enabling a customized insert 18 to be laminated by the application of heat and pressure between the transparent cover sheet 15 and the folder sheet 3 and optionally with spots of non-agressive pressure sensitive adhesive under the customized insert sheet. The heat seal 23 is formed merely by melting a narrow strip of the adhesive along side portions of the folder. Dot welds could also be used. The heat seal can be used as a fiducial whereby the side edge of the customized insert sheet 18 abuts the seal after insertion of the insert sheet in the direction of arrow 10 in a direction perpendicular the the heat seal 23. The Figures illustrate two plastic cover sheets, and hence the aforesaid components have been labled with corresponding numbers but have been primed. The second plastic cover sheet is optional and can be omitted to save costs.

After insertion of one or more customized insert sheets 18, the major face portions 11 and 13 are folded over one another so that they face each other. This can be performed by rotating the folder portions in the direction of arrows 20 and 20'. The resulting sandwich is passed through the laminator in the direction indicated by arrow 10, so that the side edge seal portion 23 becomes the leading edge of the sandwich which is passed through the aforesaid entrance roller pair of the pouch laminator in a direction perpendicular to the side edge portion and also perpendicular to the roller axes. As mentioned above, this procedure eliminated the plastic cover sheet wrinkling problem caused by the presence of the adhesive strip receiving channel 12.

This wrinkling problem occurred when we placed the heat seal along the top edge 33 and fed the folded over product through the laminator in the direction of arrow 32 in the manner disclosed in the aforesaid patents to Roger Kuhns et al. When the major faces of the folder are folded over one another, the adhesive strip receiving channel 12 will extend along the right hand edge of the folder if it is fed into the laminator in the direction indicated by arrow 32. This means that the thickness of the binder strip is less than the thickness of the major face portions since the plastic cover sheets do not extend into the area of the binding strip 12. We believe that this is probably the reason for the wrinkling problem which we solved in accordance with the procedure of the present invention set forth in the preceeding paragraph.

Figure 3:
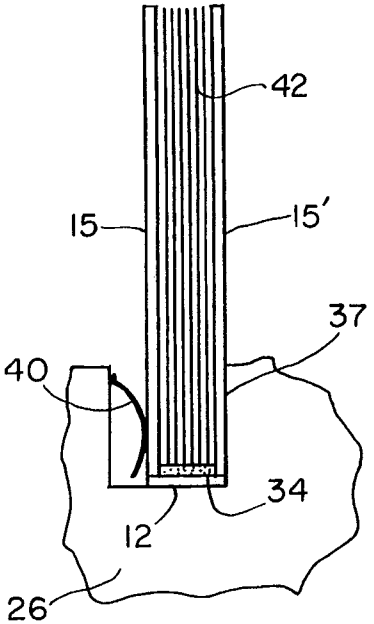
FIG. 3 illustrates the laminated presentation folder folded upwardly in position to receive the sheets to be affixed to the centrally positioned binding strip by means of perfect binding.

After the plastic cover sheet 15, the customized insert sheet 18 and the paper core sheet 3 have been laminated together, the major surface portions 11 and 13 are each rotated 90 degrees as indicated by arrows 24 and 24' so that the major surface portions now face each other. The vertically oriented folder is inserted into trough 37 formed within heat sink 26 of the perfect binding heater device which could be a portion of the aforesaid pouch laminator. A hot melt adhesive strip 34 is now positioned within the trough, parallel to the length of the trough, and strip 34 now covers the indicia 31. The sheets 42 to be bound are inserted between the two folder halves, and the edges thereof now rest against hot melt strip 34 and the upper surface portion of the adhesive strip receiving channel 12. The heater is now turned on for a predetermined time interval and perfect binding of the edges of the sheets to the inside of the folder is carried out. Conventional hot-melt perfect binding adhesive strips, typically having lengths of about ten inches and widths between 1/16–$\frac{1}{4}$ of an inch, are employed. Spring member 40 of FIG. 3 can be used to accomodate this width variation.

Indicia 31 reminds the user to reorder the folders when his supply becomes depleted. The indicia could be printed upon the adhesive strip receiving channel 12 with ordinary printing ink as follows: Reorder folders from Avant Inc: 1-800-123-4567. Normally this commercial message would be aesthetically unacceptable if printed upon customized folders of a purchaser of the folders. However, the perfect binding of the sheets covers the message so that it is no longer visible. However, if the folders are not always used for perfect binding, the message would remain visible if not printed on the underside of the adhesive strip 34. In this case we can provide a second line of folders having the message 31' in FIG. 1 preferrably positioned under the heat activatable cover sheet and printed with ink which disappears upon being exposed to the heat of lamination in the aforesaid laminator. See U.S. Pat. No. 4,188,139 to Pasini et al. for a description of such an ink.

Since other variations of the foregoing features will readily occur to workers in the art, the scope of the invention is to be limited solely by the terms of the following claims and art recognized equivalents thereof.

We claim:

1. Method of producing a wrinkle free presentation folder which can have perfect binding sheets affixed thereto comprising the steps of:

(a) providing a folder sheet having (a-1) a pair of closely spaced parallel vertically oriented folds extending from a top portion of the folder sheet to a bottom portion of the folder sheet for dividing the folder sheet into a first major portion and a second major portion and for defining a perfect binding adhesive strip receiving channel between the first major portion and the second major portion;

(a-2) a light transmissive plastic cover sheet attached to a first face of the folder sheet along a side edge portion of the folder sheet, but not along substantial top and bottom portions of said folder sheet, said side edge portion being parallel to the pair of closely spaced parallel vertically oriented folds defining the adhesive strip receiving channel, and said cover sheet having a heat activatable portion facing the folder sheet for enabling a customized insert sheet to be laminated between the plastic cover sheet and the folder sheet;

(b) inserting a customized insert sheet between the plastic cover sheet and the first face of said folder sheet;

(c) folding the second major portion of the folder sheet over the first major portion thereof;

(d) feeding the side edge portion of the folder sheet first through a laminating machine and in a direction perpendicular to the side edge portion of said folder sheet for laminating the plastic cover sheet to the folder sheet by the application of heat and pressure to said plastic cover sheet and said folder sheet, thereby to prevent the adhesive strip receiving channel from causing wrinkling of the plastic cover sheet.

2. The method of claim 1 further including applying a perfect binding adhesive strip to the adhesive strip receiving channel, and perfect binding edge portions of a stack of paper sheets to the adhesive strip by the application of heat thereto.

3. Method of producing a wrinkle free presentation folder which can have perfect binding sheets affixed thereto comprising the steps of:

(a) providing a folder sheet having (a-1) a pair of closely spaced parallel vertically oriented folds extending from a top portion of the folder sheet to a bottom portion of the folder sheet for dividing the folder sheet into a first major portion and a second major portion and for defining a perfect binding adhesive strip receiving channel between the first major portion and the second major portion;

(a-2) a light transmissive plastic cover sheet attached to a first face of the folder sheet along a side edge portion of the folder sheet, but not along substantial top and bottom portions of said folder sheet, said side edge portion being parallel to the pair of closely spaced parallel vertically oriented folds defining the adhesive strip receiving channel, and said cover sheet having a heat activatable portion facing the folder sheet for enabling a customized insert sheet to be laminated between the plastic cover sheet and the folder sheet;

(a-3) a heat activatable plastic backing sheet affixed to a second face of the folder sheet opposite the first face thereof for preventing warping of the folder sheet due to heat lamination of the plastic cover sheet to the folder sheet;

(b) inserting a customized insert sheet between the plastic cover sheet and the first face of said folder sheet;

(c) folding the second major portion of the folder sheet over the first major portion thereof;

(d) feeding the side edge portion of the folder sheet first through a laminating machine and in a direction perpendicular to the side edge portion of said folder sheet for laminating the plastic cover sheet to the folder sheet by the application of heat and pressure to said plastic cover sheet and said folder sheet, thereby to prevent the adhesive strip receiving channel from causing wrinkling of the plastic cover sheet.

4. The method of claim 3 further including applying a perfect binding adhesive strip to the adhesive strip receiving channel, and perfect binding edge portions of a stack of paper sheets to the adhesive strip by the application of heat thereto.

5. Method of producing a presentation folder which can have perfect binding sheets affixed thereto comprising the steps of:

(a-1) providing a folder sheet having a first major portion and a second major portion and a perfect binding adhesive strip receiving channel between the first major portion and the second major portion;

(a-2) a light transmissive plastic cover sheet attached to a face of the folder sheet, said cover sheet having a heat activatable portion facing the folder sheet for enabling a customized insert sheet to be laminated between the plastic cover sheet and the folder sheet;

(b) inserting a customized insert sheet between the plastic cover sheet and the first face of said folder sheet;

(c) folding the second major portion of the folder sheet over the first major portion thereof;

(d) feeding the folder sheet through a laminating machine for laminating the plastic cover sheet to the folder sheet by the application of heat and pressure to said plastic cover sheet and said folder sheet.

6. The method of claim 5 further including applying a perfect binding adhesive strip to the adhesive strip receiving channel, and perfect binding edge portions of a stack of paper sheets to the perfect binding adhesive strip by the application of heat thereto.

7. A presentation folder for laminating a customized insert sheet thereon and for optionally perfect binding a stack of sheets thereto, comprising:

(a) a folder sheet having a first major portion and a second major portion and a perfect binding adhesive strip receiving channel between the first major portion and the second major portion;

(b) a light transmissive plastic cover sheet attached to a first face of the folder sheet, said light transmissive plastic cover sheet having a heat activatable portion facing the folder sheet for enabling a customized insert sheet to be laminated between the plastic cover sheet and the folder sheet;

wherein said plastic cover sheet is attached to said folder sheet along a side edge portion thereof but not along substantial top and bottom portions thereof, said side edge portion being parallel to said adhesive strip receiving channel.

8. The folder of claim 7 including a heat activatable plastic backing sheet affixed to a second face of the folder sheet opposite the first face thereof for preventing warping of the folder sheet due to heat produced during lamination of the plastic cover sheet to the folder sheet.

9. The folder of claim 8 wherein said plastic cover sheet is attached to said folder sheet along a side edge portion thereof but not along substantial top and bottom portions thereof, said side edge portion being parallel to said adhesive strip receiving channel.

10. The folder of claim 8 wherein a message is printed upon the adhesive strip receiving channel and wherein said message would be objectionable to the user of the folder if said message would remain visible.

11. The folder of claim 7 wherein a message is printed upon the adhesive strip receiving channel and wherein said message would be objectionable to the user of the folder if said message would remain visible.

12. The folder of claim 7 wherein a message is printed upon the underside of a perfect binding adhesive strip and wherein said message would be objectionable to the user of the folder if said message would remain visible.

13. The folder of claim 7 wherein a message is printed upon the folder sheet with an ink which disappears upon exposure to heat produced during lamination and wherein said message would be objectionable to the user of the folder if said message would remain visible.

14. A presentation folder comprising:

(a) a folder sheet having a pair of closely spaced parallel vertically oriented folds extending from a top portion of the folder sheet to a bottom portion of the folder sheet for dividing the folder sheet into a first major portion and a second major portion and for defining a perfect binding adhesive strip receiving channel between the first major portion and the second major portion; and (b) a light transmissive plastic cover sheet attached to a first face of the folder sheet, said cover sheet having a heat activatable portion facing the folder sheet for enabling a customized insert sheet to be laminated between the plastic cover sheet and the folder sheet;

wherein said plastic cover sheet is attached to said folder sheet along a side edge portion thereof but not along substantial top and bottom portions thereof, said side edge portion being parallel to said adhesive strip receiving channel.

15. The folder of claim 14 including a heat activatable plastic backing sheet affixed to a second face of the folder sheet opposite the first face thereof for preventing warping of the folder sheet due to heat produced during lamination of the plastic cover sheet to the folder sheet.

16. The folder of claim 15 wherein said plastic cover sheet is attached to said folder sheet along a side edge portion thereof but not along substantial top and bottom portions thereof, said side edge portion being parallel to said adhesive strip receiving channel.

17. The folder of claim 14 wherein a message is printed upon the adhesive strip receiving channel and wherein said message would be objectionable to the user of the folder if said message would remain visible.

18. The folder of claim 14 wherein a message is printed upon the underside of the perfect binding adhesive strip and wherein said message would be objectionable to the user of the folder if said message would remain visible.

19. The folder of claim 14 wherein a message is printed upon the folder sheet with an ink which disappears upon exposure to heat produced during lamination and wherein said message would be objectionable to the user of the folder if said message would remain visible.

* * * * *